US007900300B1

(12) United States Patent
Roberts et al.

(10) Patent No.: US 7,900,300 B1
(45) **Date of Patent: *Mar. 8, 2011**

(54) MATTRESS FOUNDATION CORNER CONNECTOR AND ASSEMBLY METHOD

(76) Inventors: Thomas A. Roberts, Morristown, TN (US); Shawn M. Parella, Morristown, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/661,068

(22) Filed: Mar. 10, 2010

Related U.S. Application Data

(63) Continuation-in-part of application No. 12/152,194, filed on May 13, 2008, now Pat. No. 7,703,155.

(51) Int. Cl.
*A47C 19/00* (2006.01)

(52) U.S. Cl. ..... 5/400; 5/282.1; 5/1; 403/231

(58) Field of Classification Search ..... 400/400, 400/200.1, 282.1; 403/364, 231, 188, 252, 403/255, 264, 262, 295, 331, 382, 401, 403; 5/400, 200.1, 282.1

See application file for complete search history.

(56) References Cited

U.S. PATENT DOCUMENTS

| | | | | | |
|---|---|---|---|---|---|
| 4,319,370 | A * | 3/1982 | Robinson | 5/201 |
| 4,391,008 | A * | 7/1983 | Yamaoka et al. | 5/200.1 |
| D278,489 | S * | 4/1985 | Ragland | D6/382 |
| D289,572 | S * | 4/1987 | Wanat | D30/118 |
| 4,729,136 | A * | 3/1988 | Santo | 5/201 |
| 4,734,946 | A * | 4/1988 | Saputo | 5/400 |
| 5,099,529 | A * | 3/1992 | Anderson | 5/400 |
| 5,469,589 | A * | 11/1995 | Steed et al. | 5/400 |
| 5,564,140 | A * | 10/1996 | Shoenhair et al. | 5/400 |
| 5,709,500 | A * | 1/1998 | Mizelle et al. | 403/364 |
| 5,758,372 | A * | 6/1998 | Lopez Diaz | 5/200.1 |
| 6,286,161 | B1 * | 9/2001 | McCall | 5/400 |
| 6,978,498 | B2 * | 12/2005 | Gavela Vazquez | 5/400 |
| 2005/0028274 | A1 * | 2/2005 | Hooper, Jr. | 5/400 |
| 2005/0039258 | A1 * | 2/2005 | Gavela Vazquez | 5/400 |
| 2005/0235417 | A1 * | 10/2005 | Koughan et al. | 5/400 |
| 2008/0235868 | A1 * | 10/2008 | Snitzer et al. | 5/201 |

* cited by examiner

*Primary Examiner* — Robert G Santos
*Assistant Examiner* — Brittany M Wilson
(74) *Attorney, Agent, or Firm* — Wooten & Shaddock, PLC

(57) ABSTRACT

A corner connector for a mattress foundation assembly and a mattress foundation assembly, wherein the corner connector includes a main body portion extending from a bottom surface to a top surface; a first corner abutment surface extending from a terminating edge of the top surface; a second corner abutment surface extending from a terminating edge of the top surface; a first side surface of the main body portion; a second side surface of the main body portion, wherein the first side surface and the second side surface are formed at substantially 90° relative to one another; a first abutment surface extending from a terminating edge of the first side surface; a second abutment surface extending from a terminating edge of the second side surface; and a radiused surface extending from a terminating edge of the first abutment surface to a terminating edge of the second abutment surface.

17 Claims, 13 Drawing Sheets

MATTRESS FOUNDATION CORNER CONNECTOR AND ASSEMBLY METHOD

CROSS-REFERENCE TO RELATED APPLICATIONS

This is a Continuation-In-Part of U.S. patent application Ser. No. 12/152,194, filed May 13, 2008 now U.S. Pat. No. 7,703,155, the disclosure of which is incorporated herein by reference.

BACKGROUND OF THE INVENTION

1. Field of the Invention

This invention relates generally to mattress foundation assemblies. In particular, the present invention relates to improved mattress foundation corner connectors, mattress foundation assemblies, and a method for constructing the mattress foundation assembly.

2. Description of Related Art

Typically, mattress foundations and bases are constructed by hand from various pieces of Pine or other lightweight woods. These built-up mattress foundations are generally formed in rectangular fashion and are sometimes sawed at each corner in an effort to replicate the rounded corners of conventional mattresses.

Various external jigs and fixtures must used in order to assemble the numerous components of the mattress foundations. Once aligned, the various pieces or components are typically nailed together.

SUMMARY OF THE INVENTION

However, constructing mattress foundations using known methods is typically time-consuming, requires relatively skilled workers, requires numerous components and tools, and does not always result in a secure or square mattress foundation.

Thus, the present invention relates generally to improved mattress foundation assemblies. In particular, the present invention relates to improved mattress foundation corner connectors, mattress foundation assemblies, and a method for constructing the mattress foundation assembly.

In various exemplary embodiments, the mattress foundation assembly is constructed of Medium Density Fiberboard (MDF) and plastic components. The overall part count is significantly lower than that of other foundations. This low parts count greatly reduces the number of contact points between components in the assembly, and virtually eliminates the potential for bothersome squeaks caused by friction.

In various exemplary embodiments, the mattress foundation assembly comprises four shaped perimeter rails (first and second side rail elements and first and second header elements), joined to four corner connector elements. The profile of the perimeter rails has been designed to provide smooth, rounded horizontal outer edges, and includes a recessed notch to accommodate a flush-mounted top deck panel. Vertical grooves are notched into the interior face of the perimeter rails and serve to align the interior support ribs and spine element during the assembly process, without the need for external jigs and fixtures.

The interior support ribs and spine element are attached together in an interlocking fashion by means of engineered half-lap joints and form the load distribution structure of the mattress foundation. The ribs and spine element, along with the top deck panel also serve to square the entire mattress foundation assembly during and after assembly.

Aesthetically, the corner connector elements serve to round the vertical outer edges of the mattress foundation assembly, while maintaining the radii of the mattress foundation assembly's top and bottom edges. Structurally, the corner connector elements provide substantial impact resistance to corner loading and flexible resistance to parallelogram deformation. In various exemplary embodiments, these qualities are improved through the inclusion of a series of molded gussets inside the corner connector elements.

The top deck panel is typically a sheet of thinner MDF, or other material, which provides a single, solid surface upon which the mattress will sit. A solid top deck panel is particularly critical for foam mattresses and is a major improvement over currently constructed mattress foundations, which use soft cardboard atop lumber slats.

In various exemplary embodiments, there is elements of the mattress foundation assembly are fastened together with adhesives. Alternatively, screws or other fastening means may be used to assemble the elements of the mattress foundation. In still other embodiments, both adhesive and screws or other fastening means may be used.

Accordingly, this invention provides a mattress foundation assembly of improved design.

This invention separately provides a mattress foundation assembly having a lower overall part count when compared to other mattress foundations.

This invention separately provides a mattress foundation assembly having improved structural stability.

This invention separately provides a mattress foundation assembly that can be assembled without the need for external jigs and/or fixtures.

This invention separately provides a mattress foundation assembly that can be scaled to accommodate any size mattress.

This invention separately provides a mattress foundation assembly that is less expensive to manufacture.

This invention separately provides a corner connector element of improved design.

This invention separately provides a scalable corner connector element.

This invention separately provides a corner connector element that is relatively light weight.

This invention separately provides a corner connector element that can be produced in mass quantity from plastic, wood, or other any other suitable material.

These and other features and advantages of this invention are described in or are apparent from the following detailed description of the exemplary, non-limiting embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
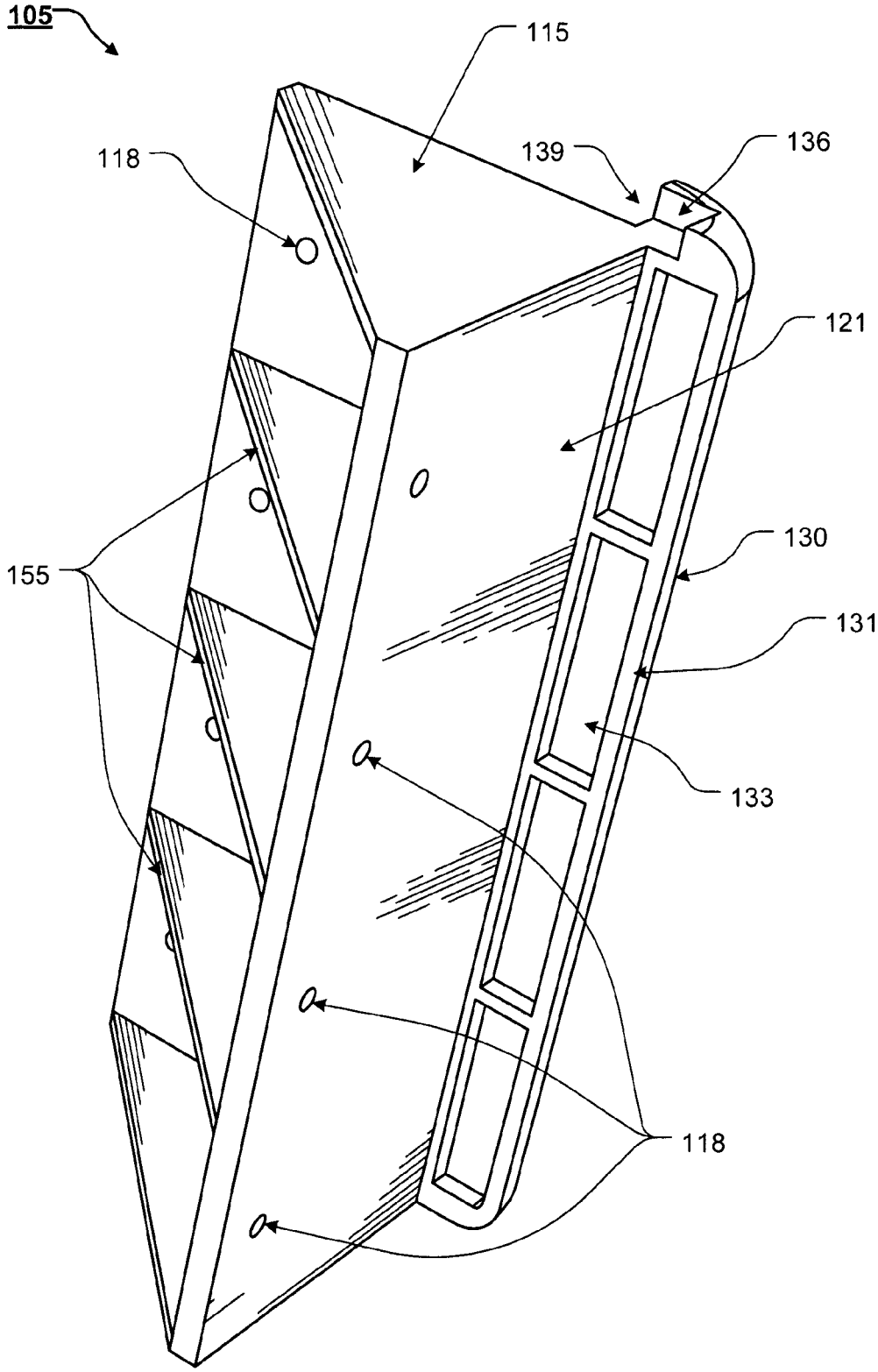
FIG. 1 shows a right perspective view of a first exemplary embodiment of a corner connector element according to this invention.
Figure 2:
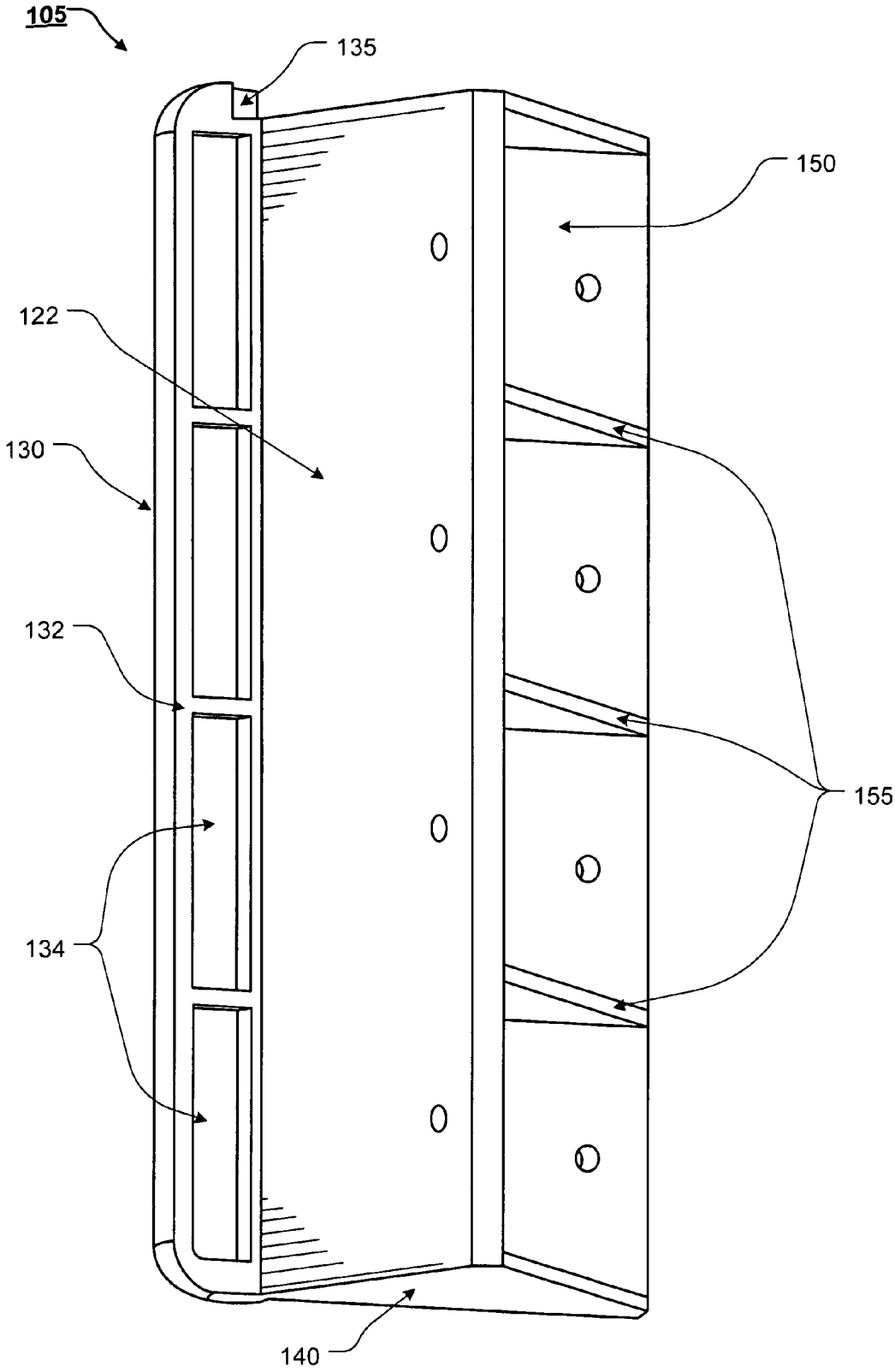
FIG. 2 shows a left perspective view of a first exemplary embodiment of a corner connector element according to this invention.
Figure 3:
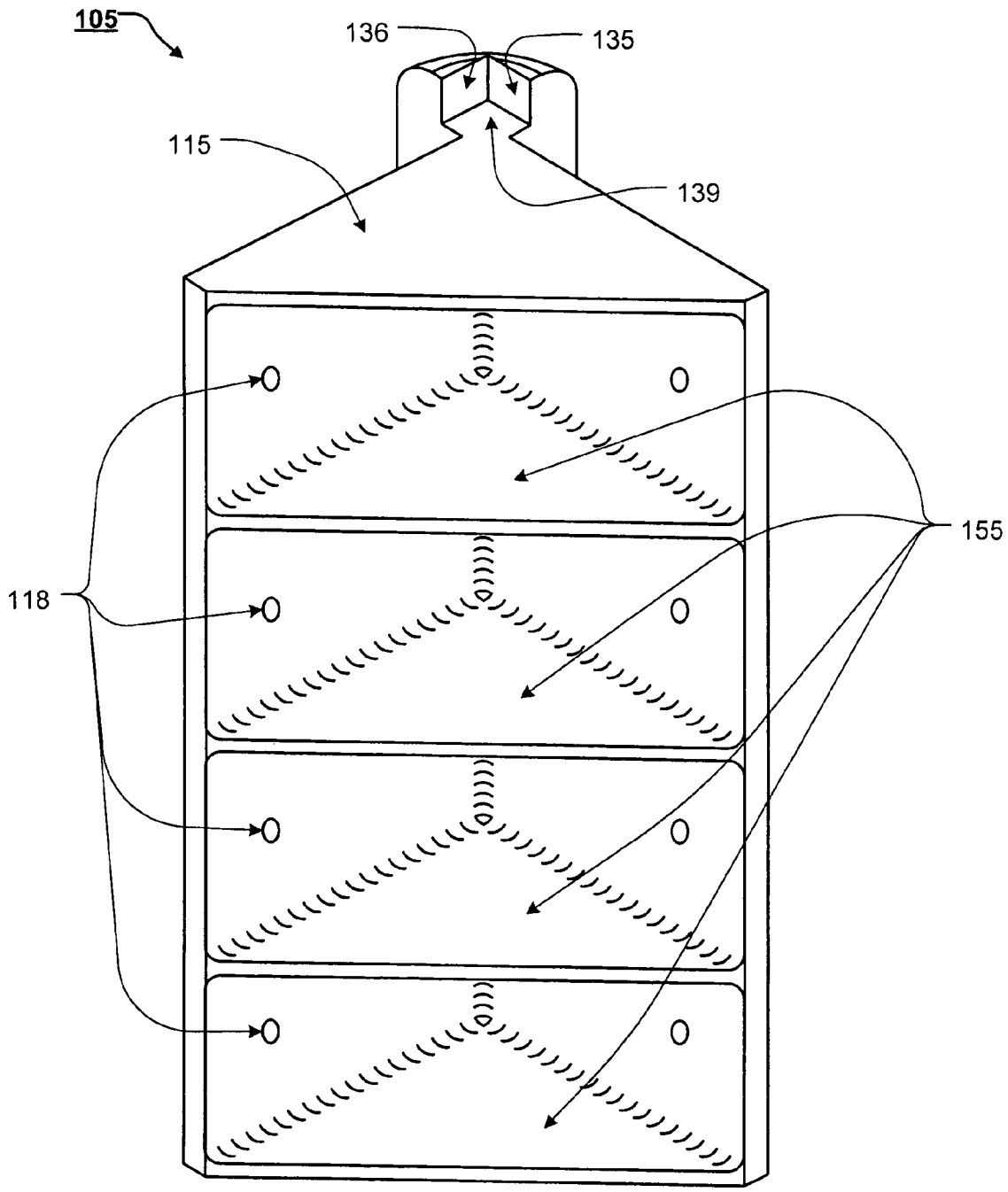
FIG. 3 shows a front perspective view of a first exemplary embodiment of a corner connector element according to this invention.
Figure 4:
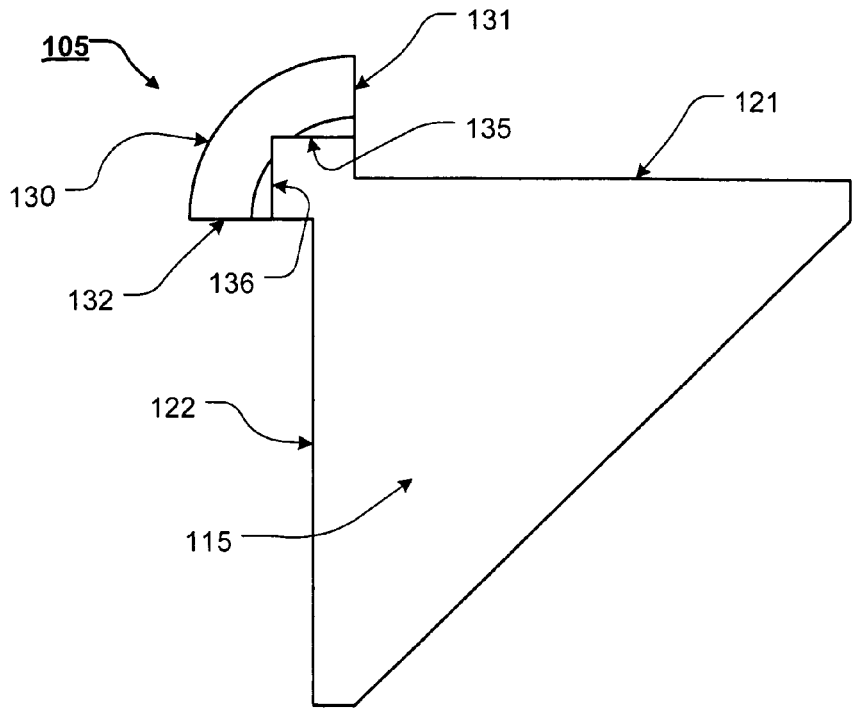
FIG. 4 shows a top view of a first exemplary embodiment of a corner connector element according to this invention.
Figure 5:
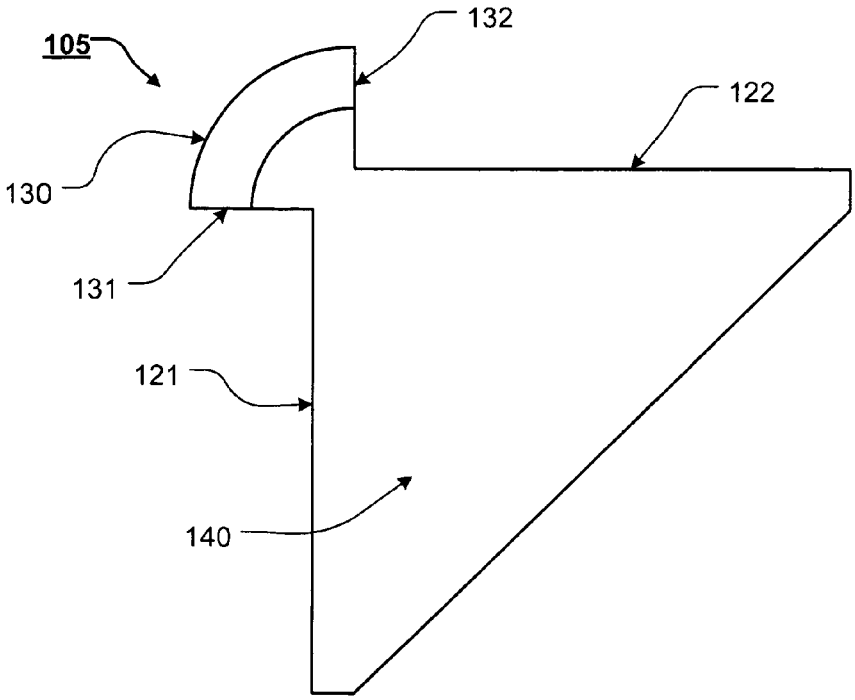
FIG. 5 shows a bottom view of a first exemplary embodiment of a corner connector element according to this invention.
Figure 6:
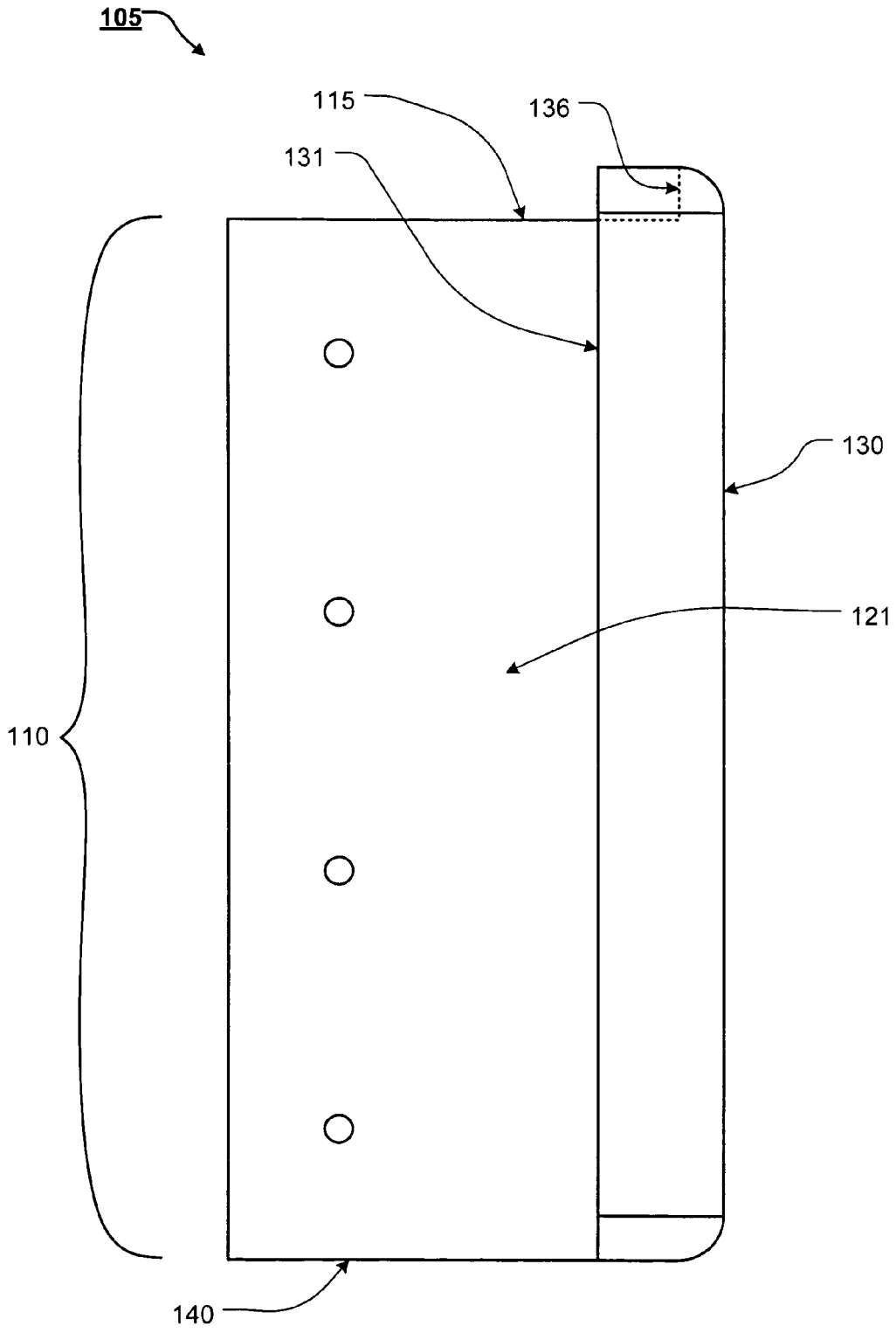
FIG. 6 shows a right plan view of a first exemplary embodiment of a corner connector element according to this invention.

For simplicity and clarification, the design factors and operating principles of the mattress foundation corner connectors and mattress foundation assemblies according to this invention are explained with reference to various exemplary embodiments of mattress foundation corner connectors and/or mattress foundation assemblies according to this invention. The basic explanation of the design factors and operating principles of the mattress foundation corner connectors and mattress foundation assemblies is applicable for the understanding, design, and operation of the mattress foundation corner connectors and mattress foundation assemblies of this invention. It should be appreciated that the mattress foundation corner connectors and/or the mattress foundation assemblies can be adapted to many applications where a simplified corner connector and/or a foundation assembly is needed.

It should also be appreciated that the terms "mattress foundation", "mattress foundation assembly", and "corner connector" are used for basic explanation and understanding of the operation of the systems, methods, and apparatuses of this invention. Therefore, the terms "mattress foundation", "mattress foundation assembly", and "corner connector" are not to be construed as limiting the systems, methods, and apparatuses of this invention. Thus, the terms "mattress foundation" and "mattress foundation assembly" are to be understood to broadly include any structures or devices capable of supporting a load, while the term "corner connector" is to be understood to broadly include any structure or device capable of joining two elements at a given angle.

Turning now to the drawing Figs., FIGS. 1-6 show a first exemplary embodiment of a corner connector element 105 according to this invention. In an illustrative, non-limiting embodiment of this invention, as illustrated in FIGS. 1-6, the corner connector element 105 comprises at least some of a main body portion 110, a top surface 115, a first side surface 121, a second side surface 122, a radiused surface 130, a first abutment surface 131, a second abutment surface 132, a first corner abutment surface 135, a second corner abutment surface 136, a corner 139, and a bottom surface 140.

As illustrated in FIGS. 1-6, the main body portion 110 extends from the substantially planar bottom surface 140 to the substantially planar top surface 115.

The first side surface 121 and the second side surface 122 are substantially planar and are formed at substantially 90° relative to one another. One or more optional attachment apertures 118 may be formed in or through the first side surface 121 and the second side surface 122. If included, the one or more optional attachment apertures 118 may be sized so as to allow a fastening means, such as, for example, a screw, to more easily attach to the corner connector element 105.

The first abutment surface 131 extends substantially perpendicularly from a terminating edge of the first side surface 121. Likewise, the second abutment surface 132 extends substantially perpendicularly from a terminating edge of the second side surface 122. The radiused surface 130 extends from a terminating edge of the first abutment surface 131 to a terminating edge of the second abutment surface 132.

A first portion of the first abutment surface 131 and the second abutment surface 132 extends above the top surface 115, while a second portion of the first abutment surface 131 and the second abutment surface 132 terminates at the top surface 115.

In various exemplary embodiments, as illustrated in FIGS. 1-6, an interior portion of the main body portion 110, wherein the interior portion is defined substantially between the bottom surface 140, the top surface 115, the first side surface 121, and the second side surface 122, is at least partially hollow. In these exemplary embodiments, one or more strengthening ribs 155 may optionally be formed within the hollow portion 150 of the interior portion. The one or more strengthening ribs 155 may provide additional strength and/or rigidity to the main body portion 110.

In various exemplary embodiments, the first corner abutment surface 135 extends substantially perpendicularly from a terminating edge of the top surface 115 and the second corner abutment surface 136 extends substantially perpendicularly from a terminating edge of the top surface 115.

The corner 139 is defined by the intersection of the first corner abutment surface 135 and the second corner abutment surface 136. It should be appreciated that the first corner abutment surface 135 and the second corner abutment surface 136 are formed at substantially 90° relative to one another.

In various exemplary embodiments, as illustrated in FIGS. 1-6, one or more recesses 133 are optionally formed in the first abutment surface 131. Likewise, one or more recesses 134 are optionally formed in the second abutment surface 132. The one or more recesses 133 and one or more recesses 134 may provide additional strength and/or rigidity to the first abutment surface 131 and the second abutment surface 132, respectively.

In various exemplary embodiments, the corner connector element 105 is substantially rigid and is formed of a polymeric material such as a polymeric composite. Alternate materials of construction may include one or more of the following: wood, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the corner connector element 105 is a design choice based on the desired appearance and functionality of the corner connector element 105.

It should be appreciated that the corner connector element 105 may be integrally formed. Alternatively, suitable materials can be used and sections are elements made independently and attached or coupled together, such as by adhesives, staples, screws, nails, or other fasteners, to form the corner connector element 105.

It should be understood that the overall size and shape of the corner connector element 105, and the various portions thereof, is a design choice based upon the desired functionality and/or appearance of the corner connector element 105. Additionally, it should be appreciated that the corner connector element 105 is formed such that multiple corner connector elements 105 may be rotated and used as each of the four corners of a mattress foundation assembly 100. Therefore, multiple corner connector elements do not have to be formed for a specific location at a specific corner of a mattress foundation assembly 100.

Figure 7:
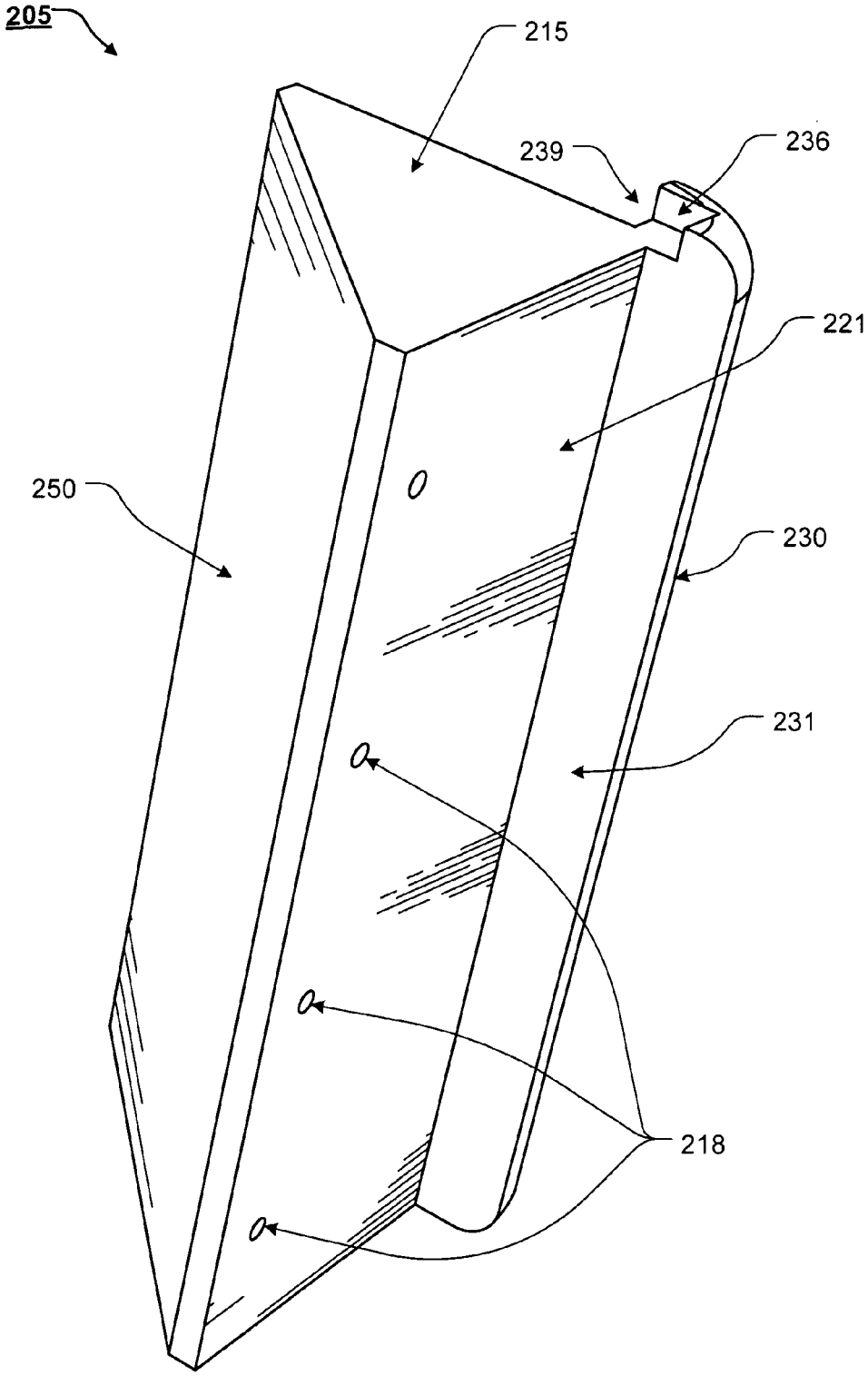
FIG. 7 shows a right perspective view of a second exemplary embodiment of a corner connector element according to this invention.
Figure 8:
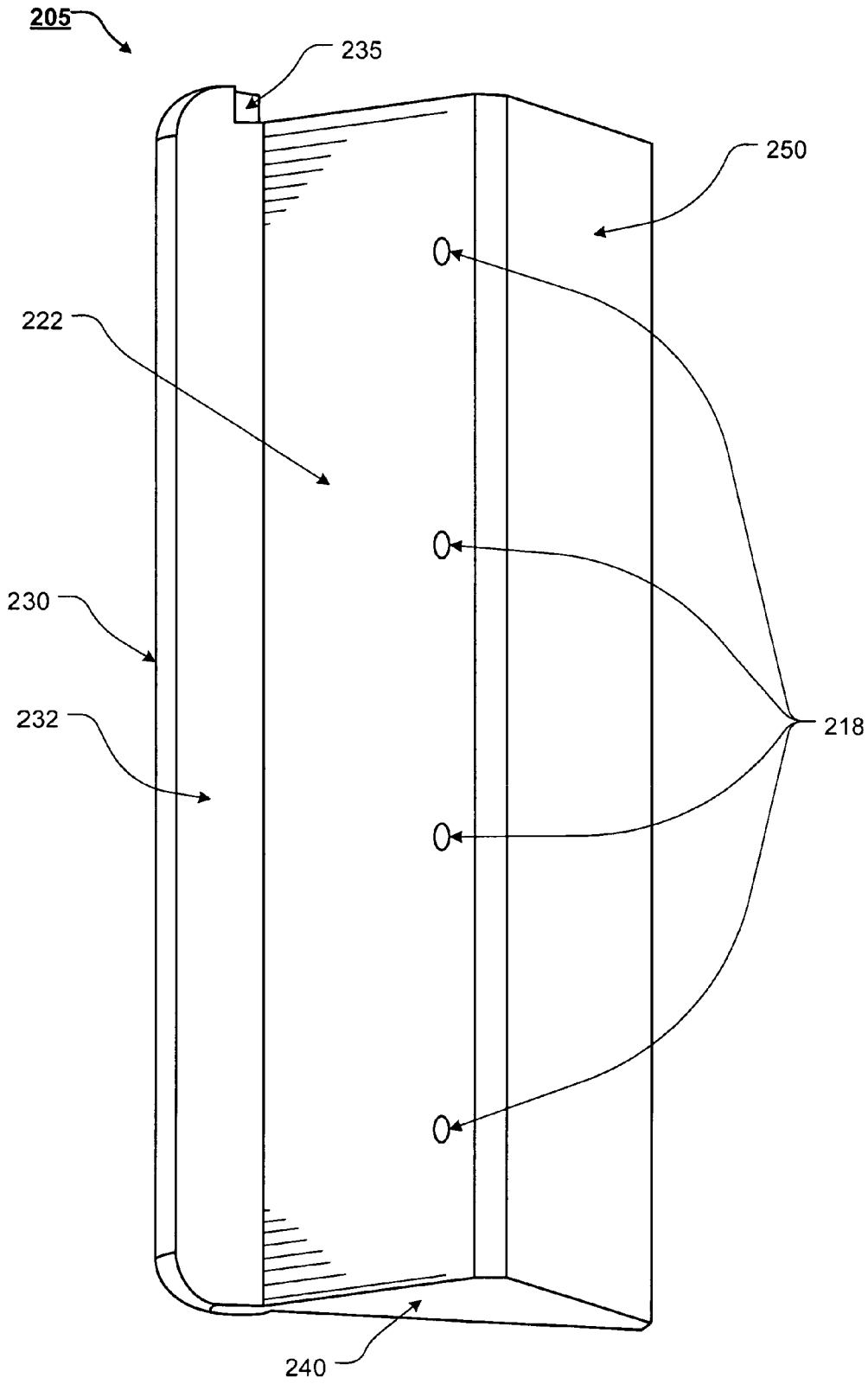
FIG. 8 shows a left perspective view of a second exemplary embodiment of a corner connector element according to this invention.
Figure 9:
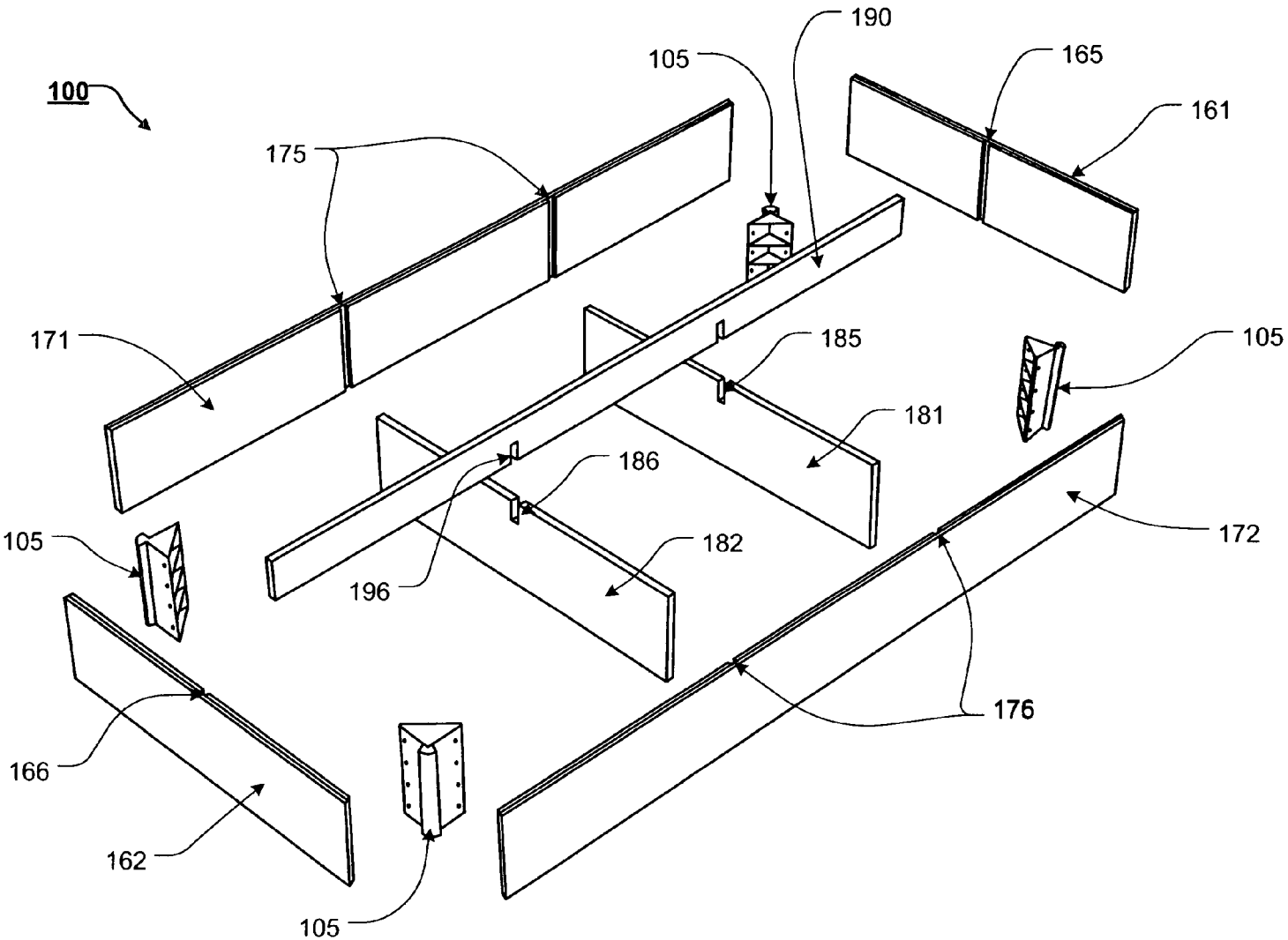
FIG. 9 shows an exploded perspective view of a first exemplary embodiment of certain of the components of a mattress foundation assembly according to this invention.

FIGS. 7 and 8 illustrate a second exemplary embodiment of a corner connector 205 according to this invention. As shown in FIGS. 7 and 8, the corner connector 200 includes at least some of a main body portion, a top surface 215, one or more attachment apertures 218, a first side surface 221, a second side surface 222, a radiused surface 230, a first abutment surface 231, a second abutment surface 232, a first corner abutment surface 235, a second corner abutment surface 236, a corner 239, and a bottom surface 240.

It should be understood that each of these elements corresponds to and operates similarly to the top surface 115, one or more attachment apertures 118, a first side surface 121, a second side surface 122, a radiused surface 130, a first abutment surface 131, a second abutment surface 132, a first corner abutment surface 135, a second corner abutment surface 136, a corner 139, and a bottom surface 140, as described above with reference to the corner connector element 105 of FIGS. 1-6.

However, as shown in FIGS. 7 and 8, the hollow portion 150 of the corner connector element 105 is not included and the main body portion is solid, having a surface 250. It should be appreciated that the surface 250 may be substantially planar, concave, or convex.

Additionally, as illustrated in FIGS. 7 and 8, the one or more recesses 133 and one or more recesses 134, optionally formed in the first abutment surface 131 and the second abutment surface 132 of the corner connector element 105 of FIGS. 1-6 are not included.

As illustrated in FIGS. 9-14, the corner connector element 105 may be used to construct a mattress foundation assembly 100. It should be appreciated that either the corner connector element 105 or the corner connector element 205 (not shown in FIGS. 9-14) may be used to construct the mattress foundation assembly 100.

As illustrated in FIGS. 9-14, the mattress foundation assembly 100 comprises at least some of a plurality of corner connector elements 105, a first header element 161 having a first header element groove 165, a second header element 162 having a second header element groove 166, a first side rail element 171 having a first side rail element receiving groove 175, a second side rail element 172 having a second side rail element receiving groove 176, a first support rib 181 having a first support rib half-lap joint 185, a second support rib 182 having a second support rib half-lap joint 186, a spine element 190 having a spine element half-lap joint 196, and a top deck panel 198.

Figure 11:
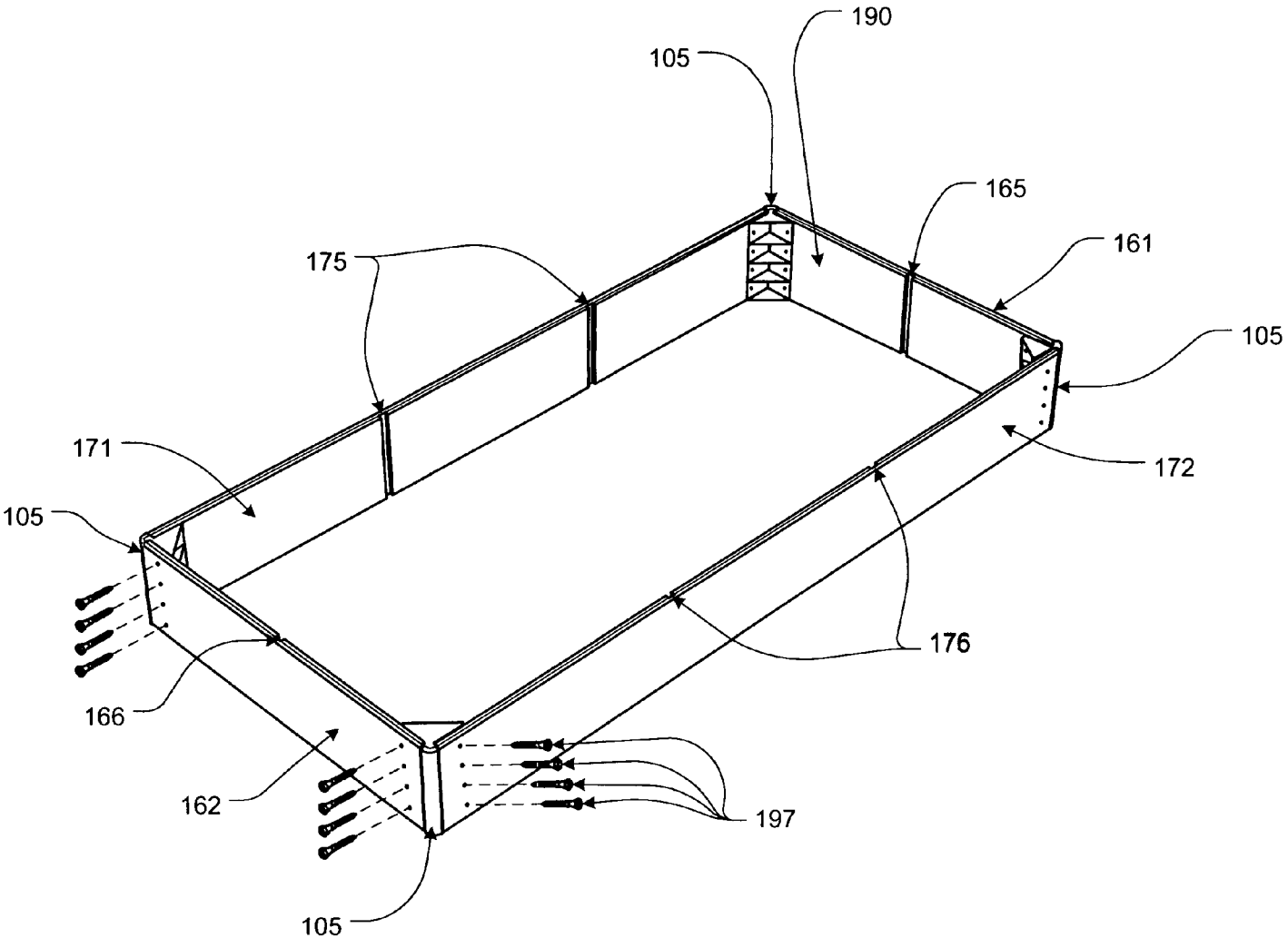
FIG. 11 shows a perspective view of a partially assembled mattress foundation assembly according to this invention.

In order to construct a mattress foundation assembly 100, four corner connector elements 105 are positioned at locations proximate the four corners of the finished mattress foundation assembly 100. Then, as illustrated in FIG. 11, the first header element 161, second header element 162, first side rail element 171, and second side rail element 172 are each attached or coupled, at their appropriate ends, to an appropriately corresponding corner connector element 105. In various exemplary embodiments, the various header and rail elements may be coupled, via fastening elements or means, such as, for example, screws 197, to the corner connector elements 105. Alternatively, the various header and rail elements may be secured to the corner connector elements 105 via an adhesive.

Each of the first header element 161, the second header element 162, the first side rail element 171, and the second side rail element 172 has at least one groove formed on an interior side of the element, perpendicular to the longitudinal axis of the element. These one or more grooves are formed so as to accept at least a portion of a support rib or spine element, as described below.

Due to the shape and placement of the first side surface 121, the second side surface 122, the first abutment surface 131, and the second abutment surface 132, so long as the first header element 161 and the second header element 162 are of an equal length and the first side rail element 171 and the second side rail element 172 are of an equal length, and so long as each of the elements 161, 162, 171, and 172 has a terminating end that is parallel and perpendicular to the longitudinal axis of the element and a planar portion, on an interior side of the element, proximate the terminating end of the element, which is parallel and perpendicular to the longitudinal axis of the element, when the interior side of the element is positioned against a corresponding first side surface 121 or the second side surface 122 of a corner connector element 105 and the terminating end is positioned against a corresponding first abutment surface 131 or second abutment surface 132, the first header element 161 and the second header element 162 will be parallel to one another and the first side rail element 171 and the second side rail element 172 will be parallel to one another.

Figure 10:
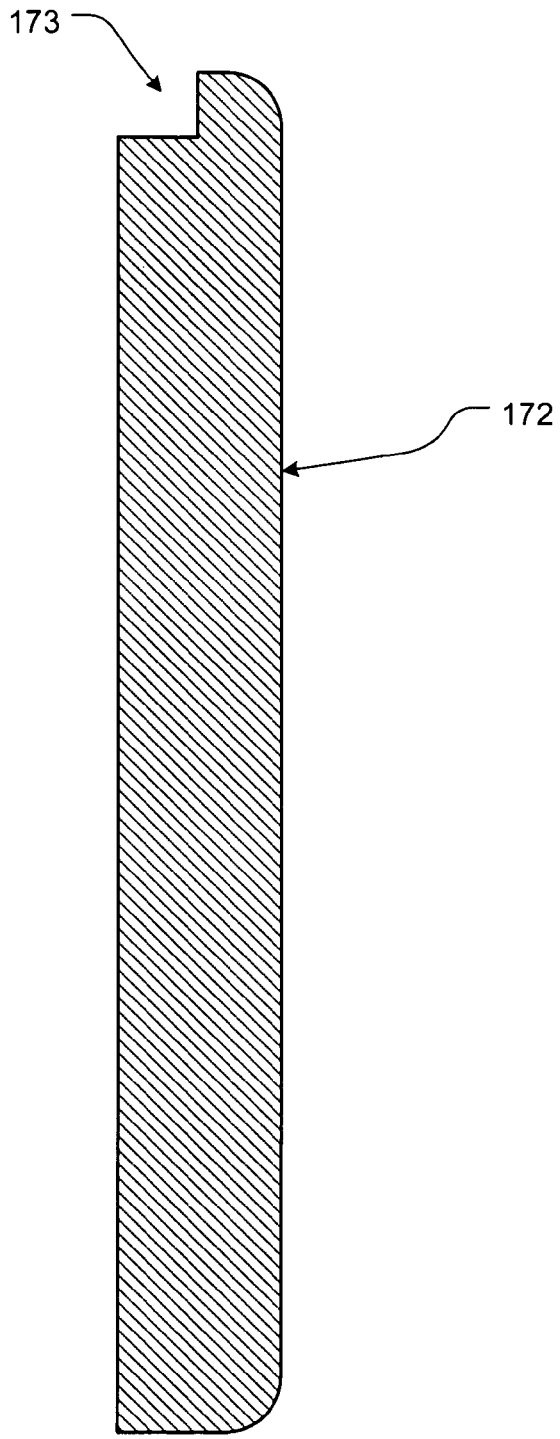
FIG. 10 shows a cross-sectional view of an exemplary side rail element according to this invention.

FIG. 10 shows a cross-sectional view of an exemplary side rail element or header element according to this invention. As illustrated most clearly in FIG. 10, each of the first header element 161, the second header element 162, the first side rail element 171, and the second side rail element 172 includes a recessed notch 173 to accommodate a flush-mounted top deck panel 198.

Figure 12:
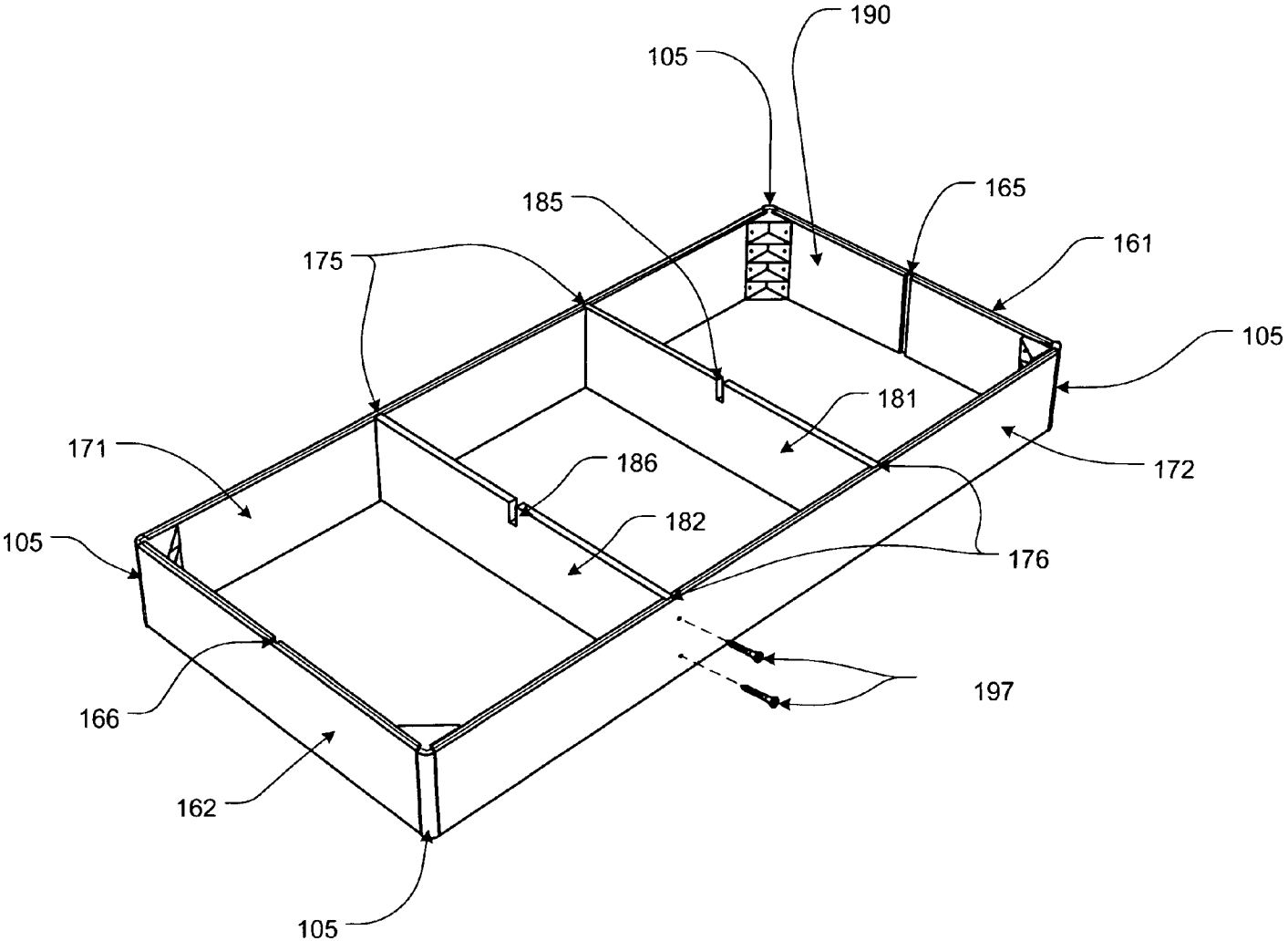
FIG. 12 shows a perspective view of a partially assembled mattress foundation assembly according to this invention.

Once each of the first header element 161, the second header element 162, the first side rail element 171, and the second side rail element 172 are attached, coupled, or secured to an appropriate corner connector element 105, as illustrated in FIG. 11, the first support rib 181 and the second support rib 182 can be positioned between the first side rail element 171 and the second side rail element 172, within corresponding first side rail element receiving grooves 175 and second side rail element receiving grooves 176, as illustrated in FIG. 12.

In various exemplary embodiments, the first support rib 181 and the second support rib 182 can be coupled, via fastening elements or means, such as, for example, screws 197, within the corresponding first side rail element receiving grooves 175 and second side rail element receiving grooves 176. Alternatively, the support ribs may be secured within receiving grooves via an adhesive.

Figure 13:
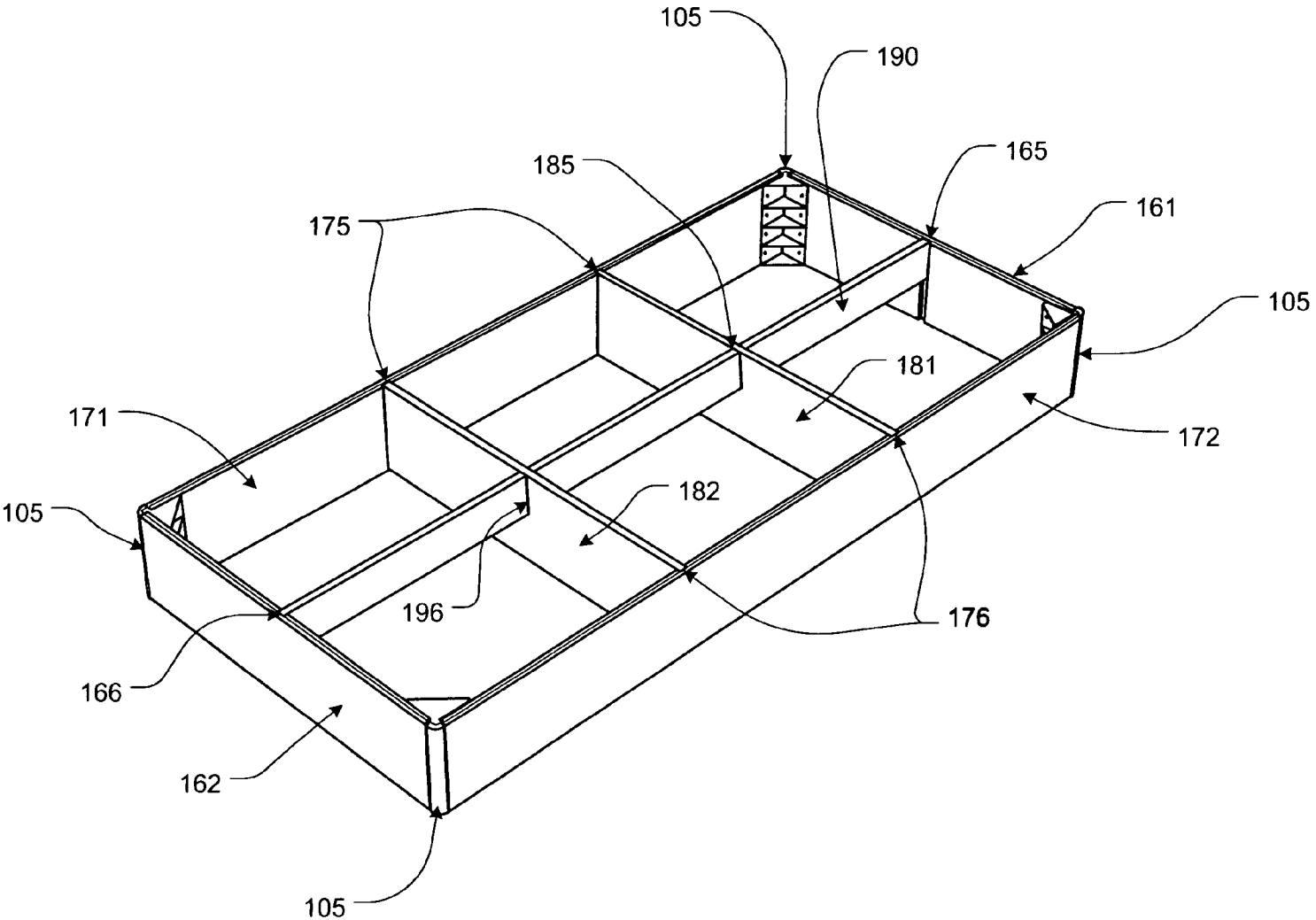
FIG. 13 shows a perspective view of a partially assembled mattress foundation assembly according to this invention.

Once each of the first support rib 181 and the second support rib 182 are attached, coupled, or secured within the corresponding receiving grooves 175 and 176, as illustrated in FIG. 12, the spine element 190 can be positioned between the first header element 161 and the second header element 162, within corresponding first header element groove 165 and second header element groove 166, as illustrated in FIG. 13.

As further illustrated in FIG. 13, because the first support rib half-lap joint 185 and the second support rib half-lap joint 186 are formed to mate with the spine element half-lap joints 196, when the spine element 190 is positioned between the first header element 161 and the second header element 162, the first support rib half-lap joint 185 and the second support rib half-lap joint 186 align with the spine element half-lap joints 196 to allow a top surface of the spine element 190 to be flush with a top surface of the first header element 161 and the second header element 162.

In various exemplary embodiments, the spine element 190 can be coupled, via fastening elements or means, such as, for example, screws (not shown), within the corresponding grooves 165 and 166. Alternatively, the support ribs may be secured within the grooves via an adhesive.

It should be appreciated that the number of spine elements 190, first support ribs 181, and second support ribs 182 is a design choice based upon the desired functionality, rigidity, and/or strength of the mattress foundation is simply 100.

Figure 14:
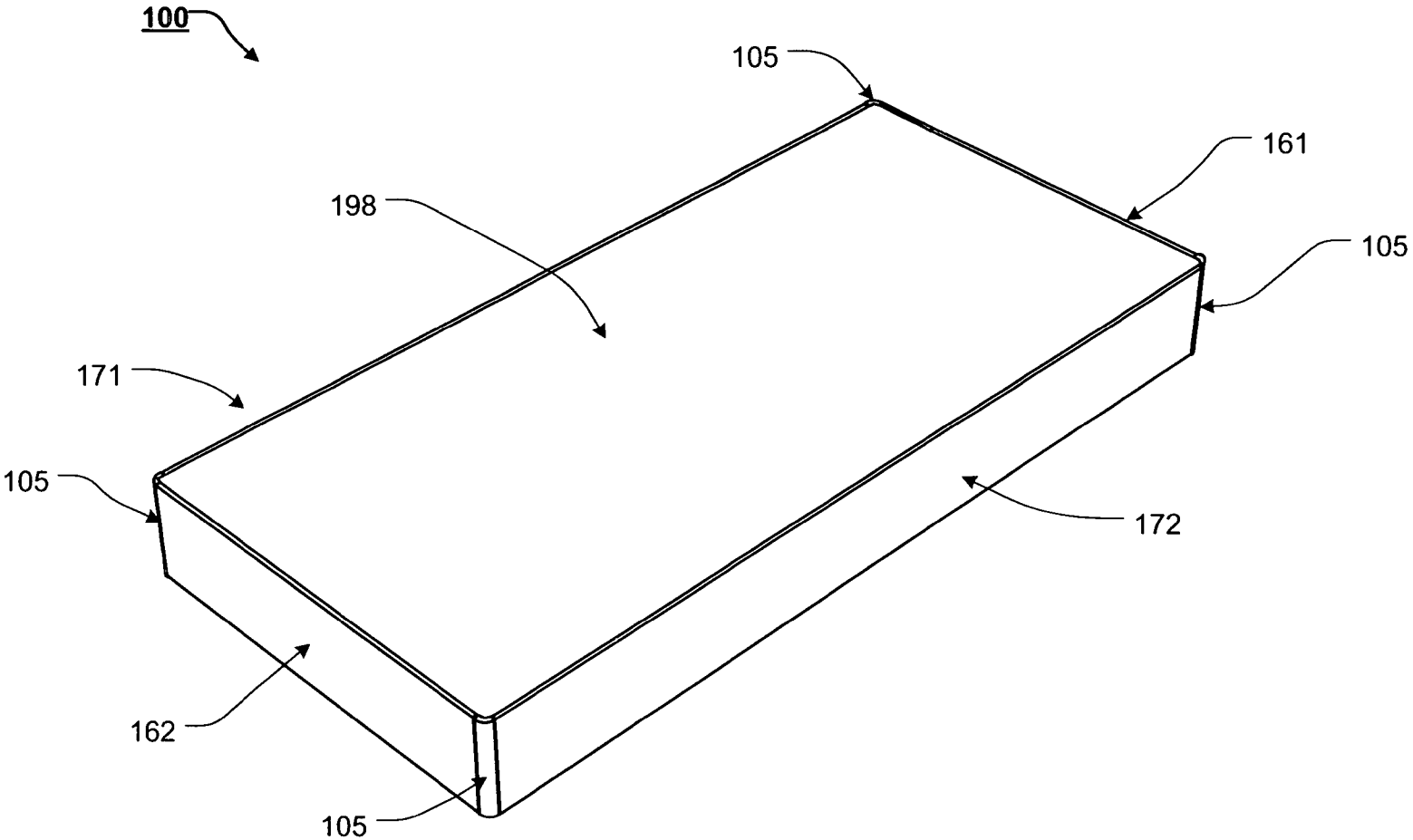
FIG. 14 shows a perspective view of an assembled mattress foundation assembly according to this invention.

Finally, as illustrated in FIG. 14, the top deck panel 198 can be placed atop the spine element 190, the first support rib 181 and the second support rib 182, within the recessed notch 173 of the first header element 161, the second header element 162, the first side rail element 171, and the second side rail element 172, so as to be flush-mounted with a top surface of the header elements 161 and 162 and the rail elements 171 and 172.

Once assembled, the mattress foundation assembly 100 can be placed in a bed frame (not shown) for receiving a mattress.

While this invention has been described in conjunction with the exemplary embodiment(s) outlined above, it is evident that this invention is not limited to particular variation(s) set forth and many alternatives, adaptations, modifications, and variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. It is to be understood that the phraseology of terminology employed herein is for the purpose of description and not of limitation. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A method for assembling a mattress foundation assembly using corner connector elements:

each corner connector element comprising:

a main body portion extending from a substantially planar bottom surface to a substantially planar top surface;

a substantially planar first side surface of the main body portion;

a substantially planar second side surface of the main body portion, wherein the first side surface and the second side surface are formed at substantially 90° relative to one another;

a first abutment surface extending substantially perpendicularly from a terminating edge of the first side surface, wherein a first portion of the first abutment surface extends above the top surface and a second portion of the first abutment surface terminates at the top surface;

a second abutment surface extending substantially perpendicularly from a terminating edge of the second side surface, wherein a first portion of the second abutment surface extends above the top surface and a second portion of the second abutment surface terminates at the top surface; and a first corner abutment surface extending substantially perpendicularly from a terminating edge of the top surface adjacent the first portion of the first abutment surface;

a second corner abutment surface extending substantially perpendicularly from a terminating edge of the top surface adjacent the first portion of the second abutment surface, wherein the first corner abutment surface and the second corner abutment surface are formed at substantially 90° relative to one another; and a radiused surface extending from a terminating edge of the first abutment surface to a terminating edge of the second abutment surface;

the method comprising:

attaching a first side surface of a first corner connector element to a first header element proximate a first terminating end of the first header element;

attaching a second side surface of a second corner connector element to the first header element proximate a second terminating end of the first header element;

attaching a first side surface of a third corner connector element to a second header element proximate a first terminating end of the second header element;

attaching a second side surface of a fourth corner connector element to the second header element proximate a second terminating end of the second header element;

attaching a second side surface of the first corner connector element to a first side rail element proximate a second terminating end of the first side rail element;

attaching a first side surface of the second corner connector element to a second side rail element proximate a first terminating end of the second side rail element;

attaching a second side surface of the third corner connector element to the second side rail element proximate a second terminating end of the second side rail element;

attaching a first side surface of the fourth corner connector element to the first side rail element proximate a first terminating end of the first side rail element;

securing a first terminating end of at least one support rib within a groove formed in an interior side of the first side rail element and securing a second terminating end of the at least one support rib within a groove formed in an interior side of the second side rail element, wherein the at least one support rib comprises at least one support rib half-lap joint formed in a top portion of the at least one support rib;

securing a first terminating end of at least one spine element within a groove formed in an interior side of the first header element and securing a second terminating end of the at least one spine element within a groove formed in an interior side of the second header element, wherein the at least one spine element comprises at least one spine element half-lap joint formed in a bottom portion of the at least one spine element to correspond to the at least one support rib half-lap joint, and wherein the at least one spine element half-lap joint is coupled to a corresponding support rib half-lap joint; and securing a top deck panel atop the at least one spine element and the at least one support rib, within a recessed notch formed in each of the first header element, the second header element, the first side rail element, and the second side rail element.

2. The method of claim 1, wherein the first header element and the second header element are of equal length.

3. The method of claim 1, wherein the first side rail element and the second side rail element are of equal length.

4. The method of claim 1, wherein one or more optional attachment apertures are formed in or through the first side surface and the second side surface.

5. The method of claim 1, wherein the main body portion further comprises an interior portion, wherein the interior portion is defined substantially between the bottom surface, the top surface, the first side surface, and the second side surface.

6. The method of claim 5, wherein the interior portion is formed of a solid portion of material.

7. The method of claim 5, wherein the interior portion is at least partially hollow.

8. The method of claim 7, wherein one or more strengthening ribs are formed within the hollow portion of the interior portion.

9. The method of claim 1, wherein a corner is defined by the intersection of the first corner abutment surface and the second corner abutment surface.

10. The method of claim 1, wherein a corner is defined by the intersection of the first corner abutment surface, the second corner abutment surface, and the top surface.

11. The method of claim 1, wherein one or more recesses are formed in the first abutment surface and the second abutment surface.

12. The method of claim 1, wherein the corner connector element is formed of a polymeric material.

13. The method of claim 1, wherein the corner connector element is formed of a metal.

14. The method of claim 1, wherein the corner connector element is formed of wood.

15. A method for assembling a mattress foundation assembly using corner connector elements:

each corner connector element comprising:

a main body portion extending from a substantially planar bottom surface to a substantially planar top surface;

a substantially planar first side surface of the main body portion;

a substantially planar second side surface of the main body portion, wherein the first side surface and the second side surface are formed at substantially 90° relative to one another;

a first abutment surface extending substantially perpendicularly from a terminating edge of the first side surface, wherein a first portion of the first abutment surface extends above the top surface and a second portion of the first abutment surface terminates at the top surface;

a second abutment surface extending substantially perpendicularly from a terminating edge of the second side surface, wherein a first portion of the second abutment surface extends above the top surface and a second portion of the second abutment surface terminates at the top surface; and a first corner abutment surface extending substantially perpendicularly from a terminating edge of the top surface adjacent the first portion of the first abutment surface;

a second corner abutment surface extending substantially perpendicularly from a terminating edge of the top surface adjacent the first portion of the second abutment surface, wherein the first corner abutment surface and the second corner abutment surface are formed at substantially 90° relative to one another; and a radiused surface extending from a terminating edge of the first abutment surface to a terminating edge of the second abutment surface;

the method comprising:

attaching a first side surface of a first corner connector element to a first header element proximate a first terminating end of the first header element;

attaching a second side surface of a second corner connector element to the first header element proximate a second terminating end of the first header element;

attaching a first side surface of a third corner connector element to a second header element proximate a first terminating end of the second header element;

attaching a second side surface of a fourth corner connector element to the second header element proximate a second terminating end of the second header element;

attaching a second side surface of the first corner connector element to a first side rail element proximate a second terminating end of the first side rail element;

attaching a first side surface of the second corner connector element to a second side rail element proximate a first terminating end of the second side rail element;

attaching a second side surface of the third corner connector element to the second side rail element proximate a second terminating end of the second side rail element;

attaching a first side surface of the fourth corner connector element to the first side rail element proximate a first terminating end of the first side rail element; and securing a top deck panel atop within a recessed notch formed in each of the first header element, the second header element, the first side rail element, and the second side rail element.

16. The method of claim 15, wherein the first header element and the second header element are of equal length.

17. The method of claim 15, wherein the first side rail element and the second side rail element are of equal length.

* * * * *